US008104147B2

(12) United States Patent
Peano

(10) Patent No.: US 8,104,147 B2
(45) Date of Patent: Jan. 31, 2012

(54) FLUID-TIGHT SLIDE FASTENER

(75) Inventor: Roberto Peano, Malnate (IT)

(73) Assignee: RIRI SA (CH)

( * ) Notice: Subject to any disclaimer, the term of this patent is extended or adjusted under 35 U.S.C. 154(b) by 875 days.

(21) Appl. No.: 12/114,290

(22) Filed: May 2, 2008

(65) Prior Publication Data

US 2009/0019675 A1 Jan. 22, 2009

(30) Foreign Application Priority Data

May 16, 2007 (EP) ..... 07009783

(51) Int. Cl.

| | |
|---|---|
| ***A44B 19/00*** | (2006.01) |
| ***A44B 19/26*** | (2006.01) |
| ***A44B 19/32*** | (2006.01) |
| ***A44B 19/36*** | (2006.01) |

(52) U.S. Cl. ..... 24/388; 24/387; 24/433; 24/436

(58) Field of Classification Search ..... 24/387, 24/389, 436, 433, 388

See application file for complete search history.

(56) References Cited

U.S. PATENT DOCUMENTS

| | | | | |
|---|---|---|---|---|
| 2,923,992 | A | 2/1960 | Armstrong et al. | |
| 3,959,858 | A | 6/1976 | Fukuroi | |
| 4,524,493 | A * | 6/1985 | Inamura | 24/389 |
| 4,825,514 | A * | 5/1989 | Akeno | 24/389 |
| 5,253,395 | A * | 10/1993 | Yano | 24/387 |
| 5,621,954 | A * | 4/1997 | Mizuno | 24/429 |
| 6,634,066 | B2 * | 10/2003 | Okada et al. | 24/433 |
| 7,392,572 | B2 * | 7/2008 | Cossutti | 24/389 |
| 7,565,722 | B2 * | 7/2009 | Kusayama et al. | 24/436 |
| 2002/0116798 | A1 * | 8/2002 | Okada et al. | 24/433 |
| 2006/0236510 | A1 * | 10/2006 | Kusayama et al. | 24/436 |
| 2007/0067969 | A1 * | 3/2007 | Kusayama et al. | 24/436 |

* cited by examiner

*Primary Examiner* — Robert J Sandy

*Assistant Examiner* — Tyler Johnson

(74) *Attorney, Agent, or Firm* — Akerman Senterfitt

(57) ABSTRACT

A fluid tight slide fastener (10) including a slider (15) slidably associated with opposite edges (12*a*) of two flanking strips (12) to provide for their closure, and an upper end stop (16) with which the slider (15) is removably engaged upon closure. A clearance-recovery wedge-like coupling is included at the upper stop (16) and in the slider (15), which includes respective tilted sections (19,21) and opposite tilted sections (46,47) to make, upon engagement of the upper stop (16) and slider (15), a clearance-recovery taper fit.

15 Claims, 20 Drawing Sheets

FLUID-TIGHT SLIDE FASTENER

FIELD OF APPLICATION

The present invention refers, in its most general aspect, to a fluid tight slide fastener in which a cursor, slidably associated to opposite edges of two flanking strips to provide for their closure, is removable engaged upon closure in an upper end stop.

In particular, the present invention concerns a slide fastener of so-called fluid tight type, since upon closure it is capable of ensuring substantial impermeability with regard to fluids, in particular water and air, also when subjected to considerable pressures.

The present invention also concerns an upper stop and a slider for a slide fastener of the aforesaid type.

In the following description, the term "fluid tight" or "waterproof" indicates the capacity of the slide fastener or parts thereof to block the passage of liquids and/or gases, in particular water and air, even when the slide fastener is subjected to considerable pressure differences, in particular a pressure difference between the outer side and the inner side of the slide fastener on the order of 2 bars.

PRIOR ART

As is known, fluid tight slide fasteners (or waterproof slide fasteners) of the aforesaid type are widely used in many different sport items and for open air activities, such as for example wet suits or for diving or sailing, camping tents and the like where it is necessary to block the passage of the water and air between the slide fastener exterior and interior, in particular also in the presence of considerable pressure differences.

In such slide fasteners, the closure of the two flanking strips is carried out by means of the reciprocal engagement of suitable closure elements, usually teeth arranged in lines along a facing longitudinal edge portion of said strips, determined by the sliding of the slider towards the upper end stop.

The slide fasteners of the aforesaid type are moreover usually equipped, at their opposite ends, with respective end stops, structured to removably engage the slider, when the fastening or opening operations of the same fastener are completed.

The aforesaid end stops are usually called upper stop and lower stop, respectively, and such name will be used below in the present description.

So that the closures of the slide fastener are entirely fluid-tight, it is necessary to attain not only a seal coupling of the flanking strips constituting it and a seal coupling between the slider and the lower stop, but also a perfect seal in the coupling between slider and upper stop.

As is known, even if it is produced with a good degree of accuracy, in the slide fasteners of the prior art, the engagement between the upper stop and the slider does not always ensure the necessary seal, due to the size tolerances normally accepted in the production of these components.

To overcome one such drawback, the prior art has proposed the formation of a ribbing, generally made in the flat parts of the upper stop and intended to come in contact with corresponding flat parts of the slider, so to make a kind of mechanical seal, a "forced coupling" (or pressure coupling).

Nevertheless, such ribbing, even if well designed and made, is subject to rapid, inevitable wear, with consequent formation of clearances which cancel the original "seal".

Another solution proposed by the prior art to ensure the seal, provides for the use of sealing materials, in particular grease, interposed between the upper stop and the slider.

Nevertheless, such material is easily removed during the use of the slide fastener, making the necessary fluid seal come less quickly and progressively, and moreover they can dirty the slide fastener or the article on which the slide fastener is applied and be in turn dirt collectors.

SUMMARY OF THE INVENTION

The technical problem underlying the present invention is that of devising and making available a slide fastener in which slider and respective upper stop have structural and functional characteristics such to ensure an optimal seal when reciprocally coupled upon completed closure, even after prolonged use and in conditions of strong stress, so to overcome the drawbacks mentioned above with reference to the prior art.

Such problem is resolved, according to the present invention, by a fluid tight slide fastener of the considered type, characterised in that respective means and counter-means are provided for in said slider and in said upper stop so to make, upon stop-slider engagement, a taper fit with clearance recovery, so-called clearance-recovery wedge.

Preferably, said means and counter-means adapted to make a taper fit with clearance recovery are formed integrally in said upper stop and in said slider, respectively.

Preferably, said means and counter-means adapted to make a clearance-recovery taper fit comprise at least one section with tilted surface formed on the upper stop and at least one matching tilted surface section formed in the slider.

Due to the present invention, and in particular to the presence of the aforesaid coupling means and counter-means, one obtains an effective recovery of the clearances between the upper stop and the slider due to the inevitable production tolerances of these components and/or the wear deriving from the prolonged use of the slide fastener, ensuring over time the necessary fluid seal between the upper stop and the slider, all this in a simple and enduring manner.

The present invention also regards an upper stop and a slider for a slide fastener of the aforesaid type which are characterised in that they comprise respective means and counter-means adapted to make, upon completed stop-slider engagement, a clearance-recovery taper fit, a so-called clearance recovery wedge.

Further characteristics and advantages of the present invention will be clear from the following description of a preferred embodiment example, given as indicative and non-limiting with reference to the attached drawings.

For ease of illustration, in FIGS. 4, 4A, 4B, 4C and 5-21 the upper stop and the slider according to the invention are shown on their own, or rather separated from the remaining components of the slide fastener, in particular the strips.

DETAILED DESCRIPTION OF A PREFERRED EMBODIMENT

Figure 1:
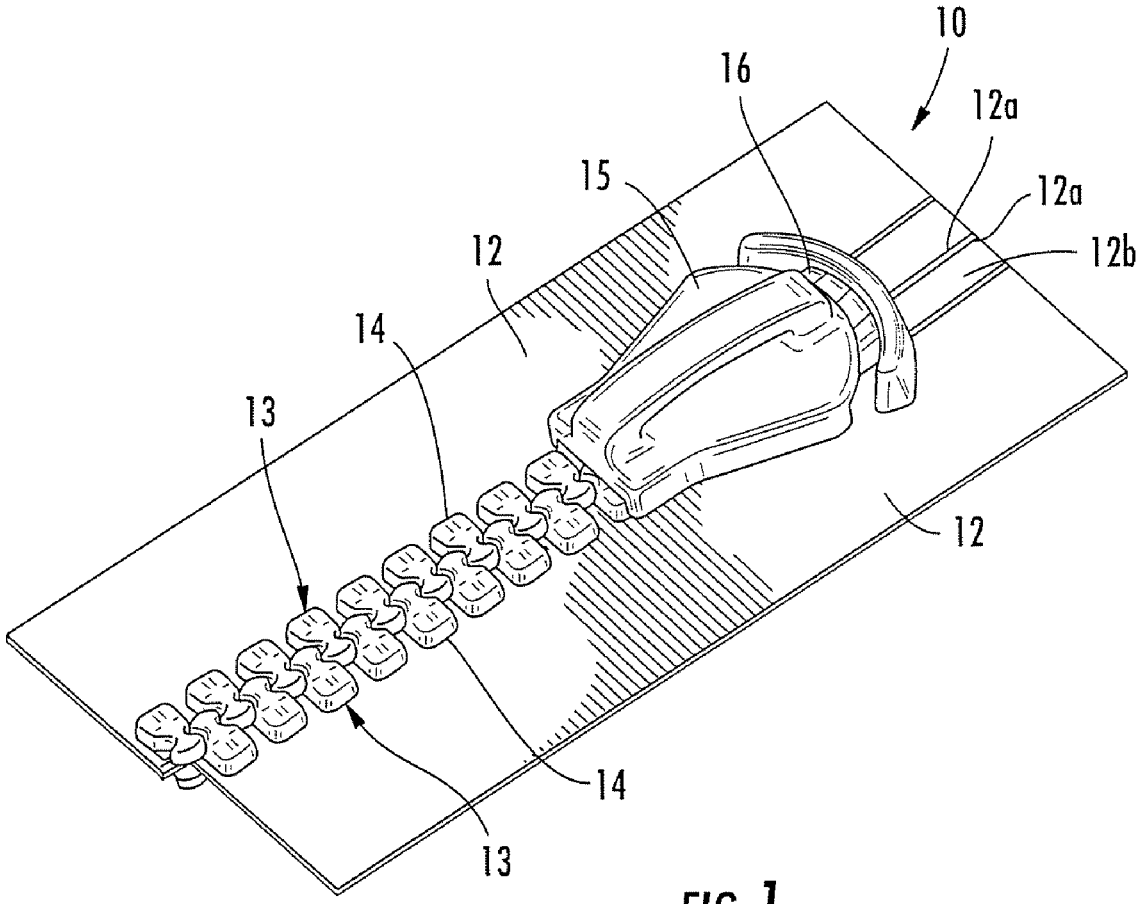
FIG. 1 represents a perspective view of a slide fastener portion according to the invention.
Figure 2:
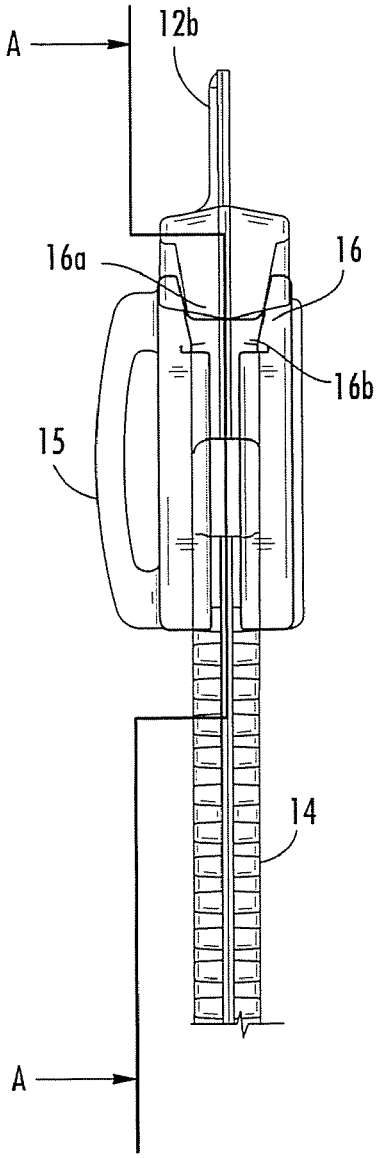
FIG. 2 represents a side view of the slide fastener portion of FIG. 1.
Figure 3:
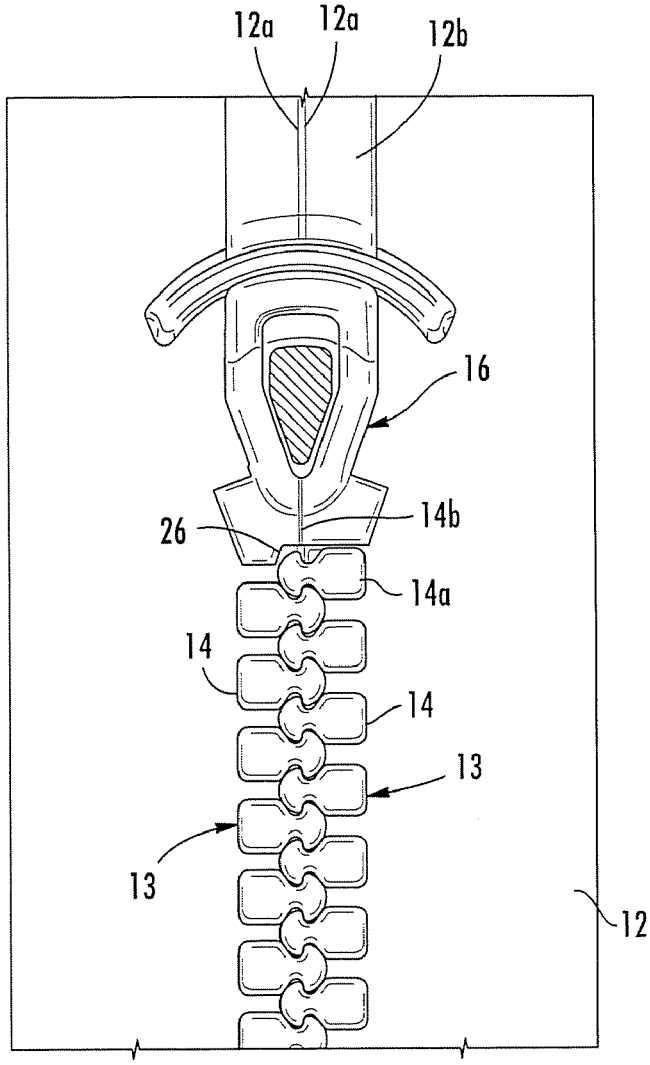
FIG. 3 represents a section view of the slide fastener portion of FIG. 1 taken along the plane of trace A-A of FIG. 2.

With reference to FIGS. 1-3, a waterproof slide fastener according to the present invention is entirely indicated with 10.

The waterproof slide fastener 10 comprises a pair of strips 12, substantially parallel and flanking each other, each having a row 13 of closure elements 14 arranged along a portion of respective facing longitudinal edges 12*a* of said strips 12.

The strips 12 are formed of a waterproof material, in particular they are usually in the form of a multilayer composite comprising a core of textile material and a covering of waterproof material, usually a thermoplastic elastomer material applied on the textile material through extrusion or lamination techniques, so to be resistance but at the same time flexible.

The closure elements are constituted in the present example by teeth 14, also made of a waterproof material, usually a thermoplastic material of adequate hardness, which are sealingly fixed to the strips with the usual injection moulding techniques.

The slide fastener moreover comprises a slider 15 slidable along said rows 13 of teeth 14 in order to fluid tight engage or disengage said teeth 14 of the strips 12, an upper stop 16 for the movement of the slider 15 in the fluid, tight engagement direction of said teeth 14 and an opposite lower stop (not shown) for the movement of the slider 15 in the disengagement direction of the teeth 14.

The upper stop 16 and the opposite lower stop are sealed to the strips 12, in close proximity of the respective upper and lower ends of the rows 13 of teeth 14, in a conventional manner, for example by means of injection moulding techniques. Moreover, the strips 12 are sealed to each other along portions of respective longitudinal edges 12*a* arranged between the upper stop 16 and the upper end of the strips 12 and between the lower stop and the lower end of the strips 12. In the present example, this is made by means of a covering 12*b* of waterproof material extended between the upper stop 16 and the upper end of the strips 12 at the longitudinal edges 12*a* of the strips. Although not shown, the same covering type can be applied between the lower stop and the lower end of the strips.

In the present embodiment (FIGS. 4 and 5), the upper stop 16 consists of a block of plastic material, comprising a head portion 19 connected to two opposite arms 18. The upper stop 16 moreover has a shoulder 20 formed integrally at the ends 22 of the head portion 19 and extending below and above therefrom. The shoulder 20 essentially has aesthetic value and does not have to be present.

Advantageously, the head portion 19 together with the opposing arms 18 are appropriately shaped so to form a seat 50 for the housing of a diamond form 40 of the slider 15, as will be better illustrated below, said seat 50 having a substantially complementary shape to that of the diamond form 40 (also known as heart form in sector jargon).

Figure 4:
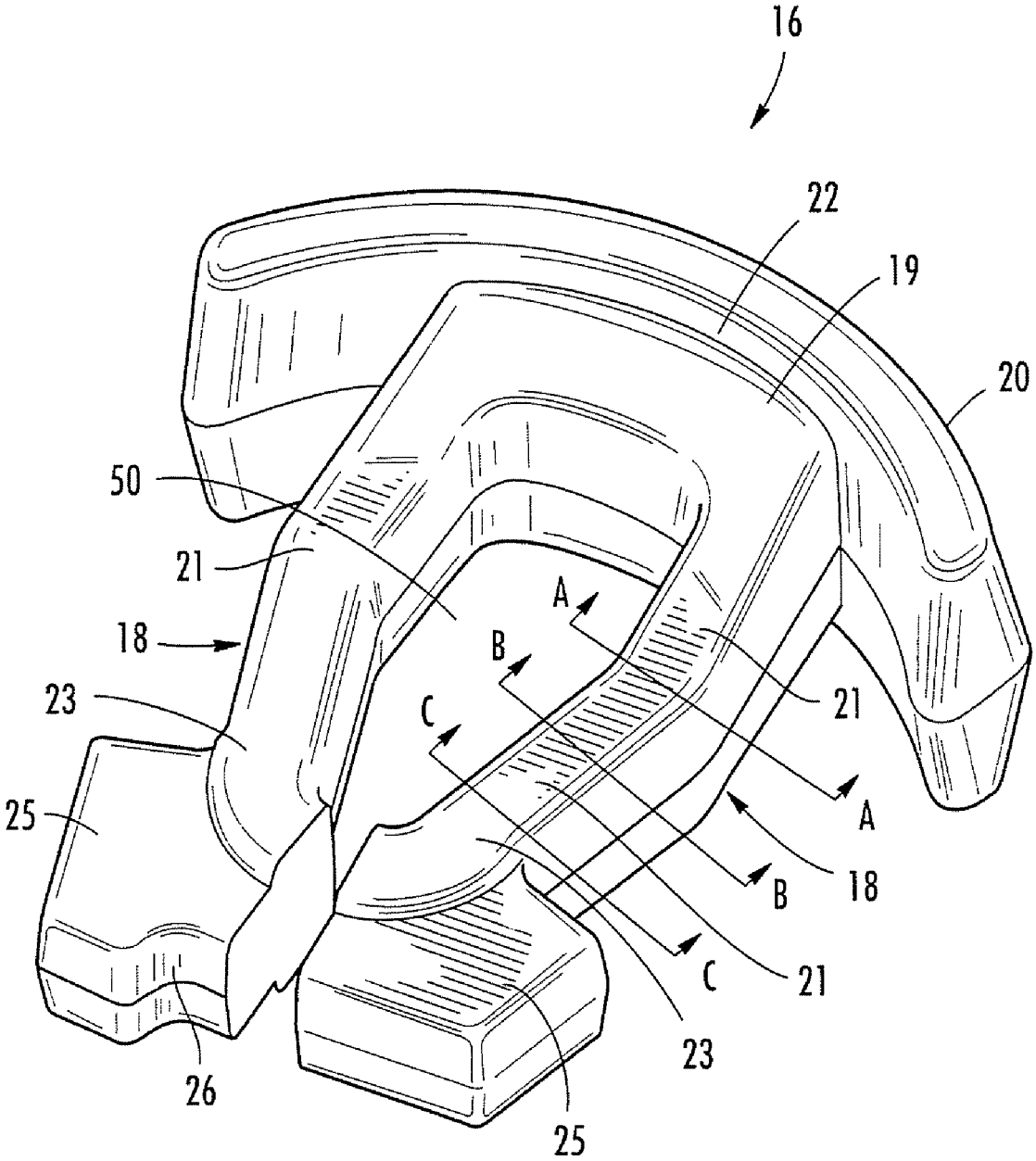
FIG. 4 represents a perspective view of the upper stop of the slide fastener of FIG. 1.
Figure 4A:
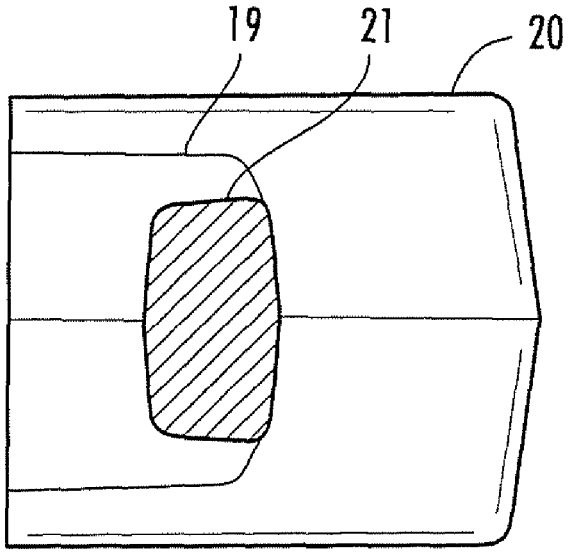
FIG. 4A represents a section view of the upper stop taken along the plane of trace A-A of FIG. 4.
Figure 4B:
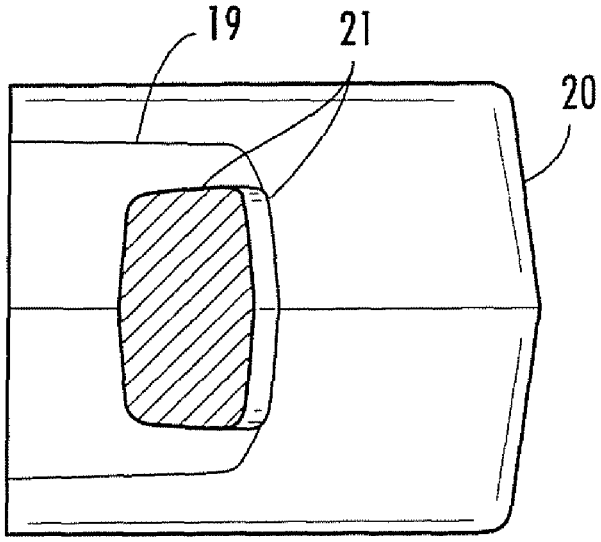
FIG. 4B represents a section view of the upper stop taken along the plane of trace B-B of FIG. 4.
Figure 4C:
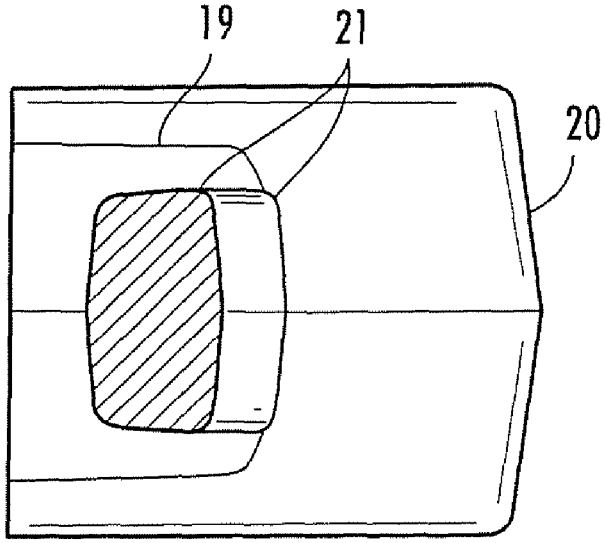
FIG. 4C represents a section view of the upper stop taken along the plane of trace C-C of FIG. 4.
Figure 4D:
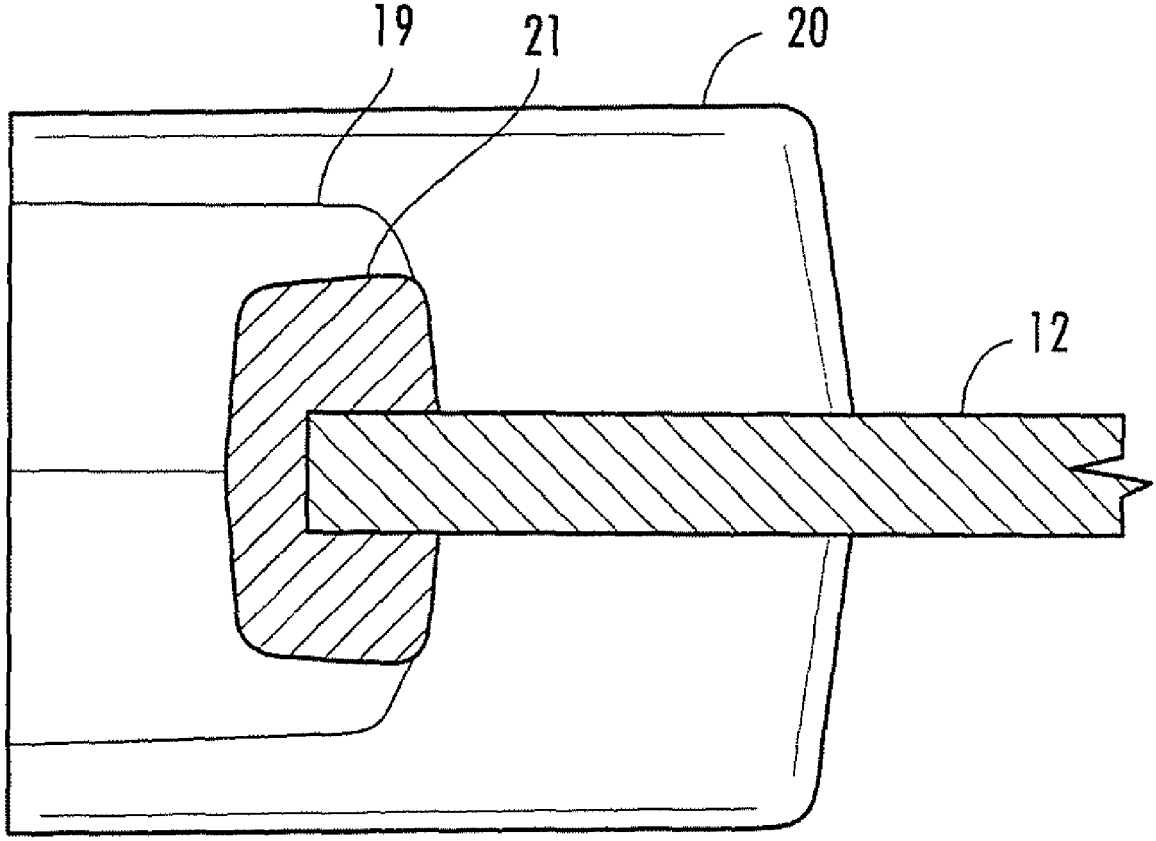
FIG. 4D represents a section view like that of FIG. 4A in which, however, the upper stop is shown associated to the strips of the slide fastener.
Figure 5:
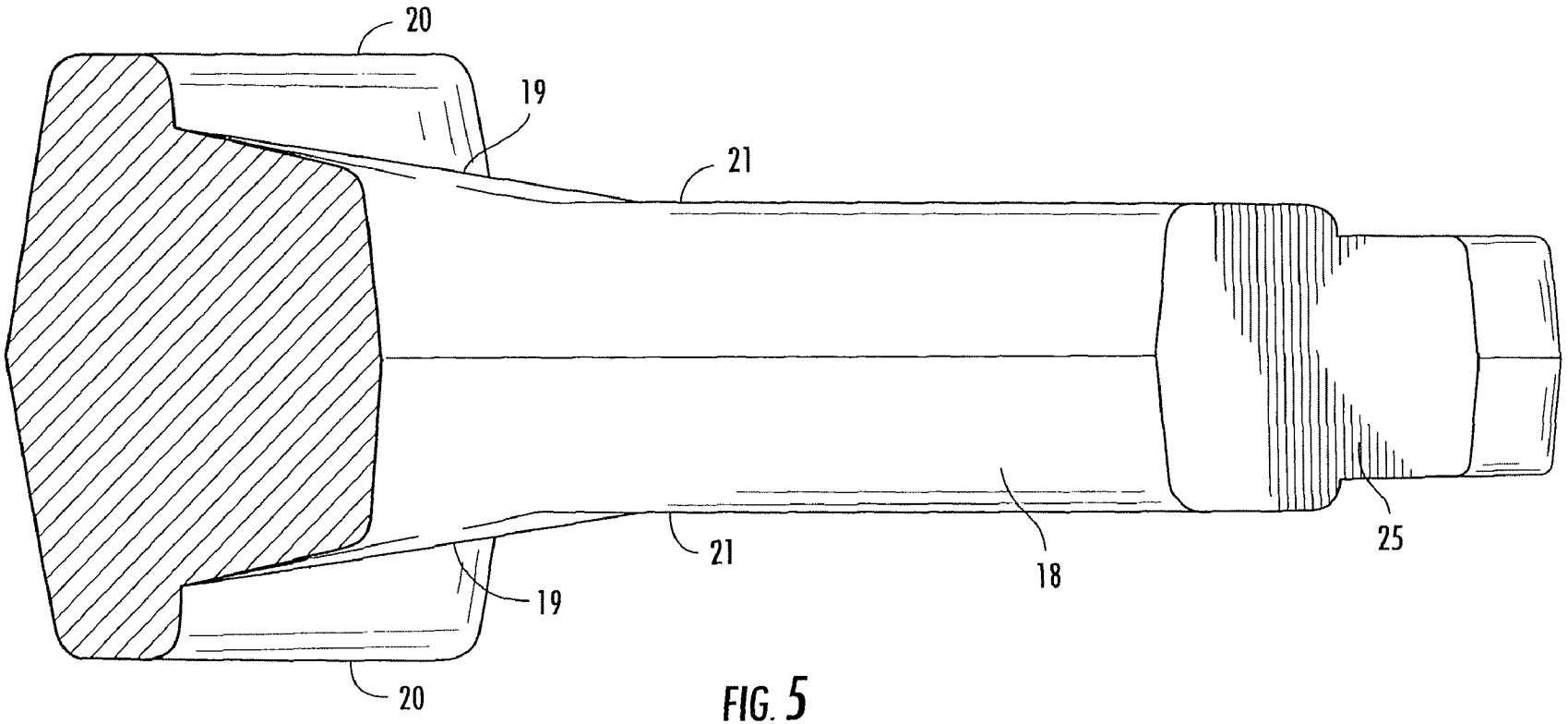
FIG. 5 represents a longitudinal section view of the upper stop of the slide fastener of FIG. 1.
Figure 8:
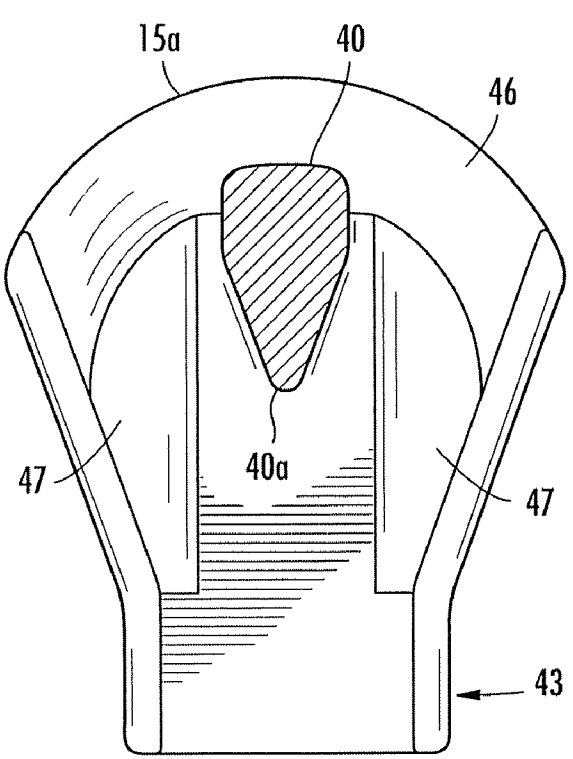
FIG. 8 represents a section view of the slider taken along the plane of trace B-B of FIG. 6.
Figure 6:
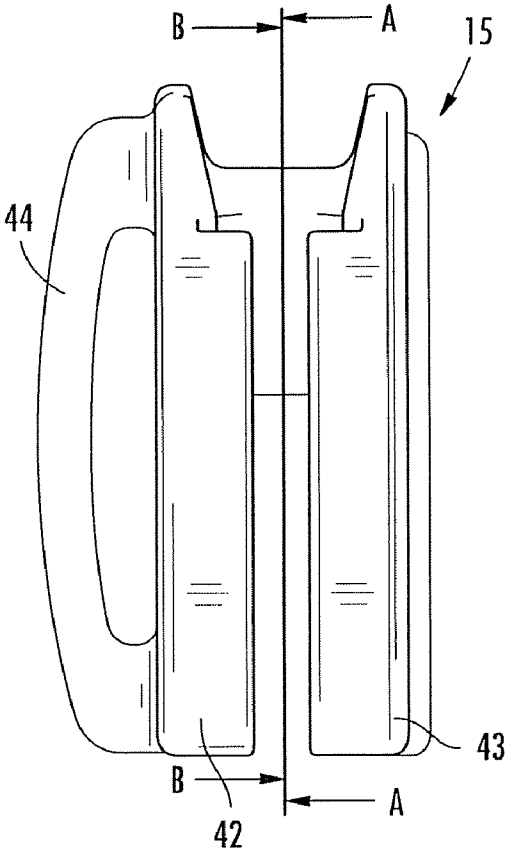
FIG. 6 represents a side view of the slider according to the invention of the slide fastener of FIG. 1.
Figure 7:
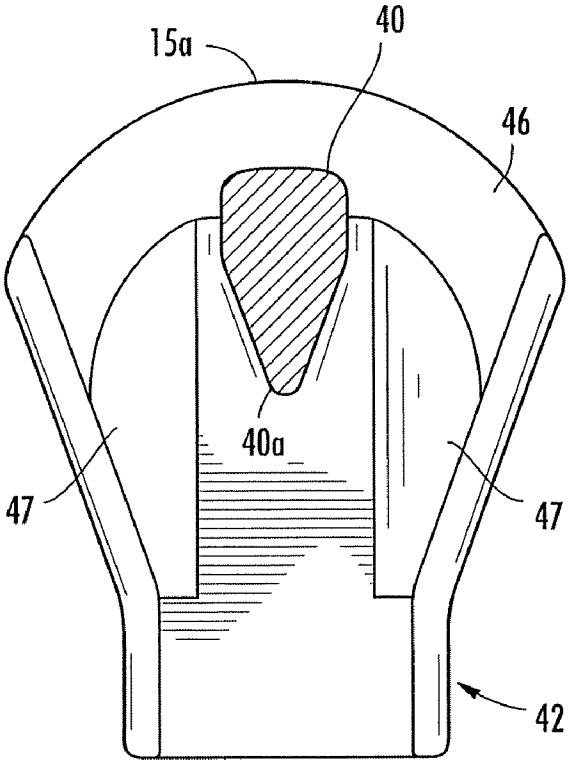
FIG. 7 represents, a section view of the slider along the plane of trace A-A of FIG. 6.
Figure 10:
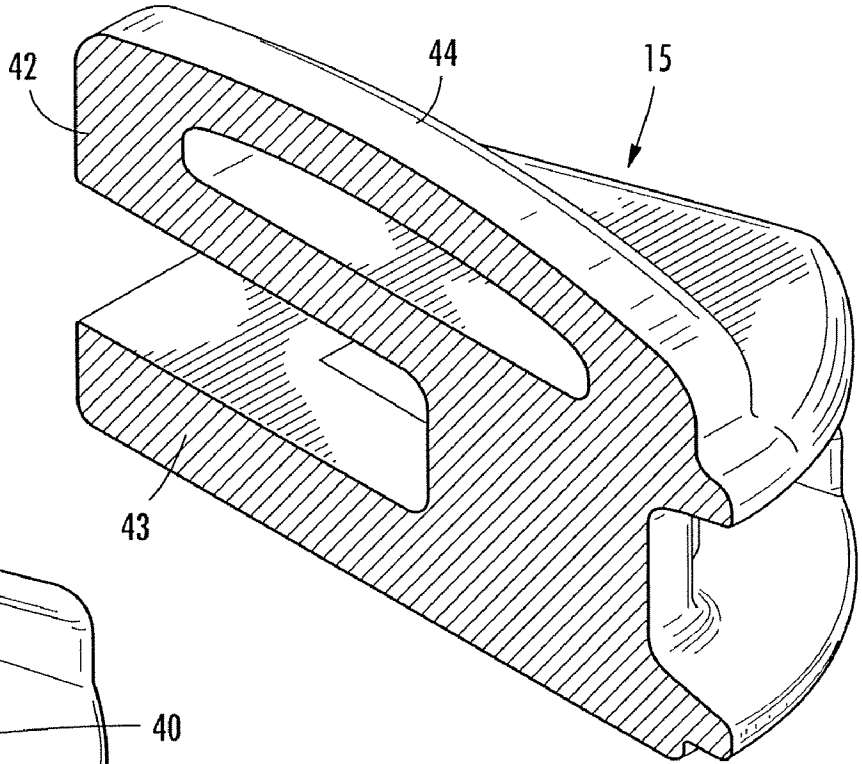
FIGS. 9 and 10 represent respective perspective and partial section views of a detail of the slider of FIG. 6.
Figure 9:
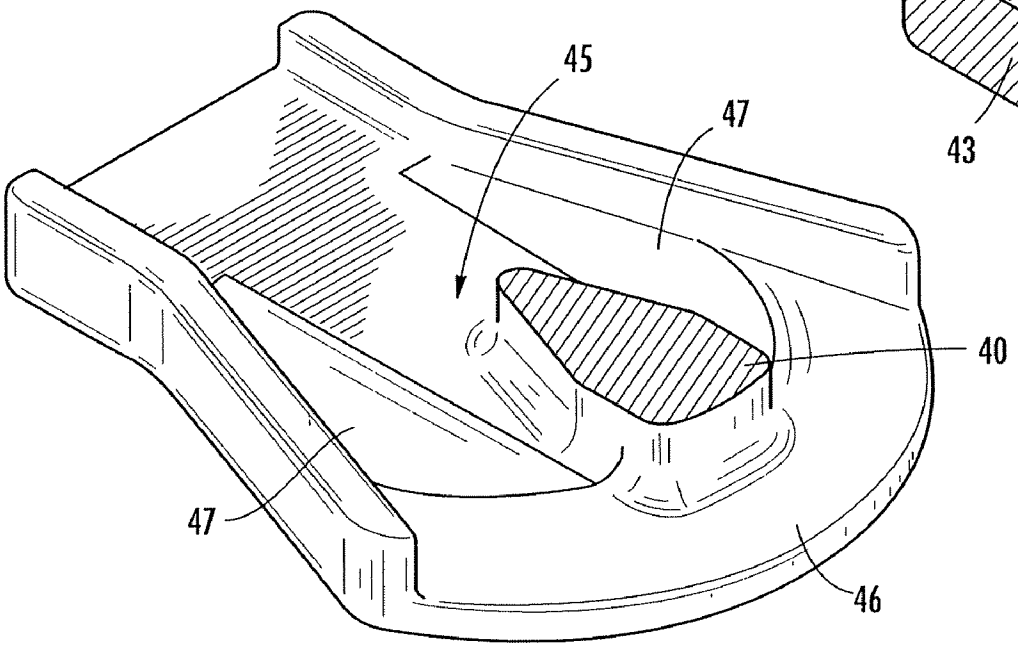
Figure 11:
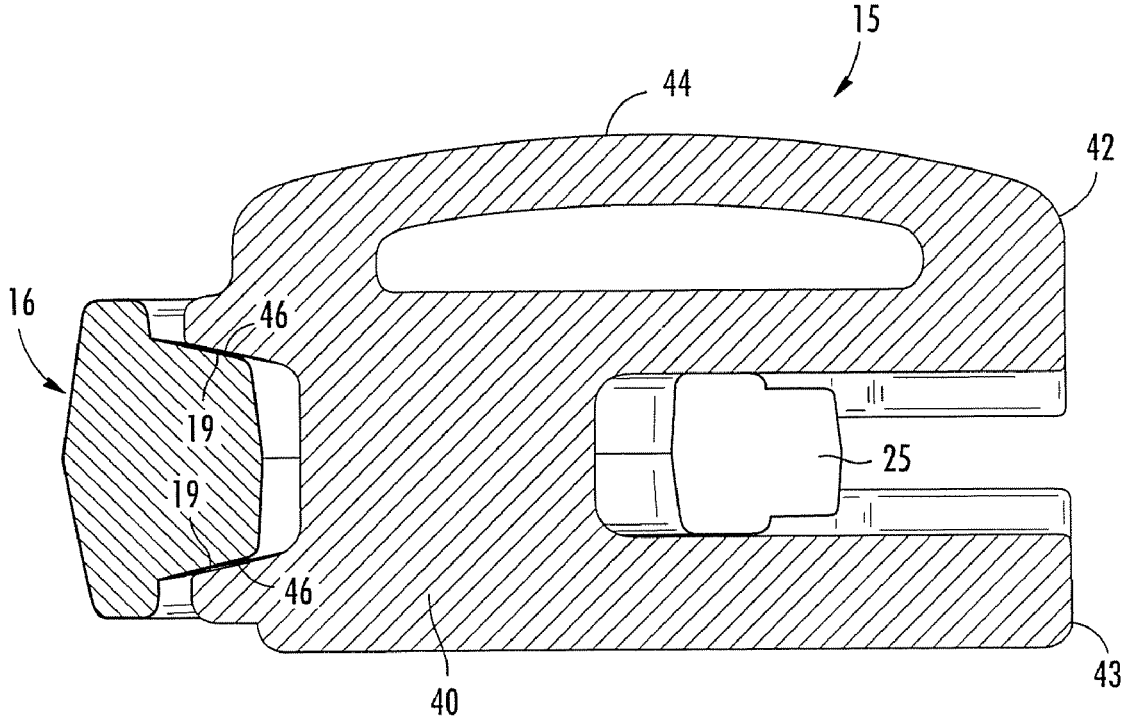
FIG. 11 represents a longitudinal section view of the slider and upper stop according to the invention, coupled to each other.
Figure 12:
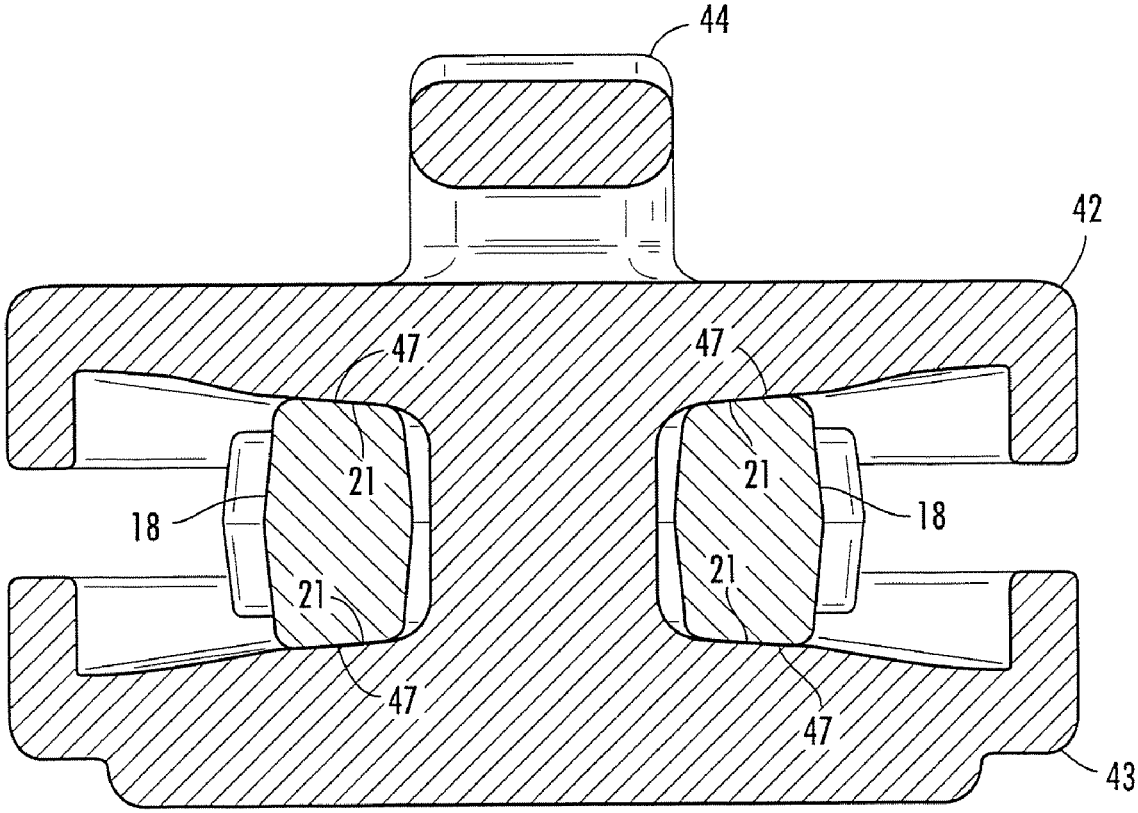
FIG. 12 represents a cross section view of the slider and upper stop according to the invention, coupled to each other, FIGS. 13 and 14 each represent a perspective and partial section view of the slider and upper stop coupled to each other.
Figure 13:
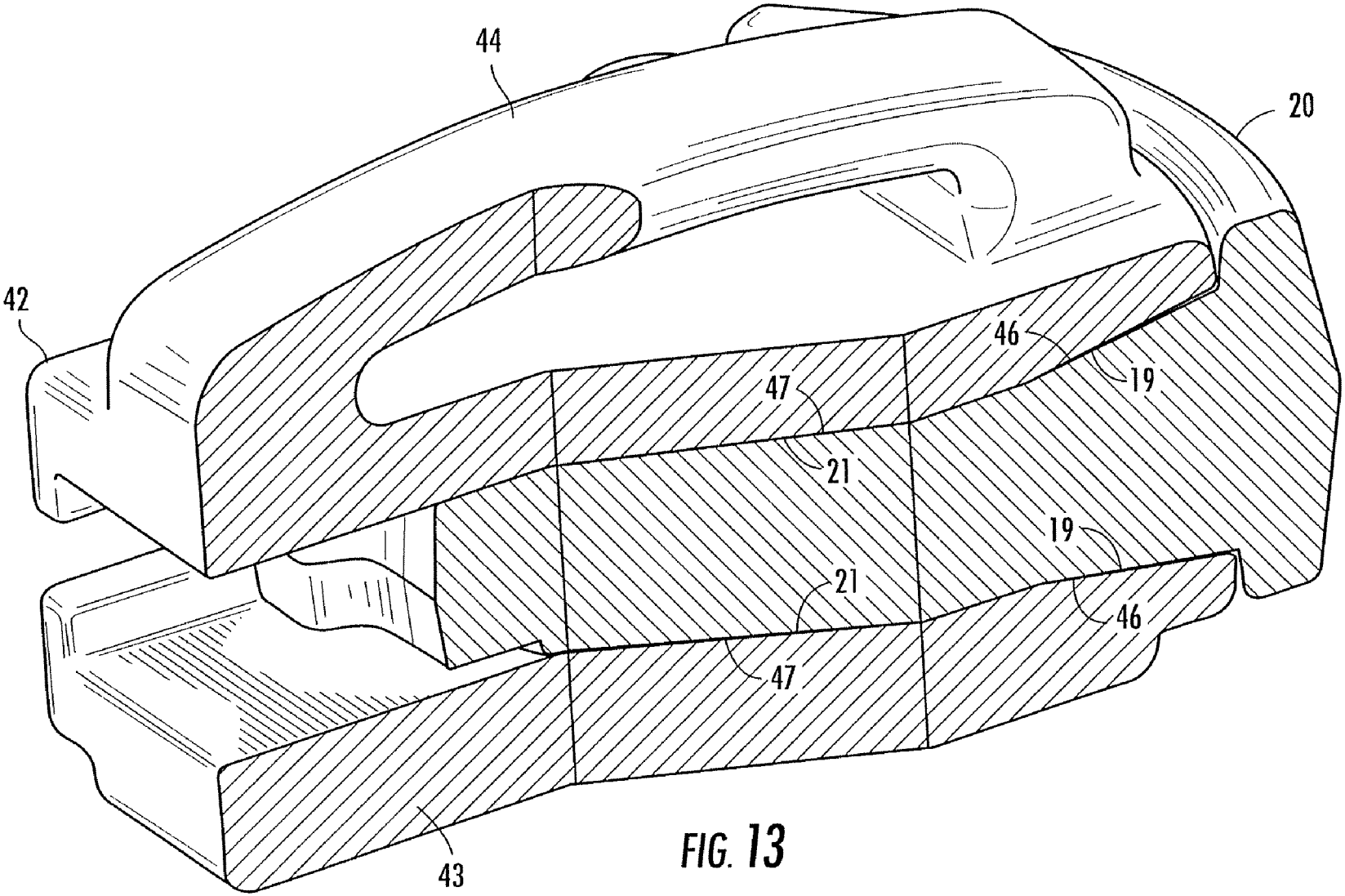
Figure 14:
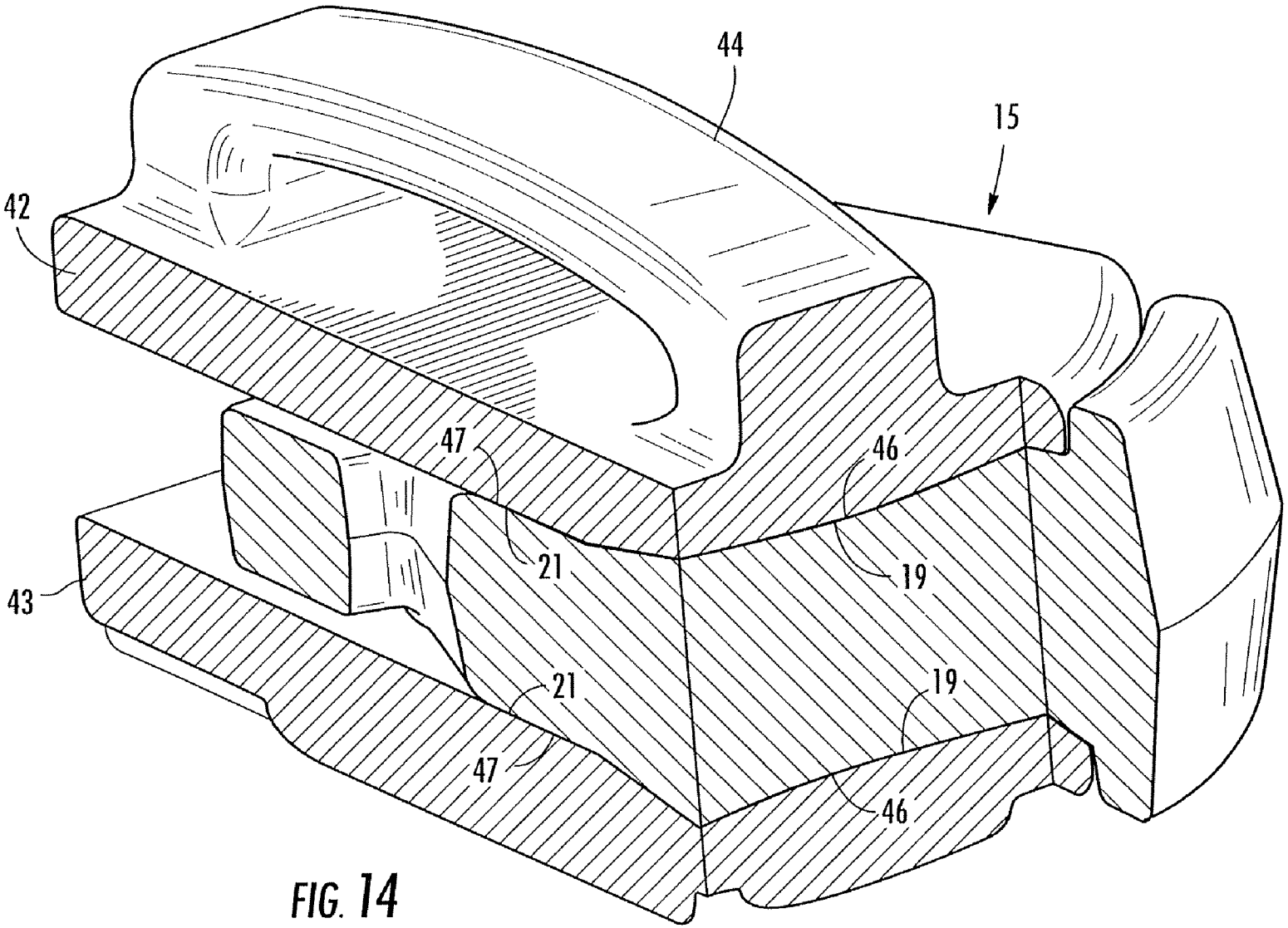
Figure 15:
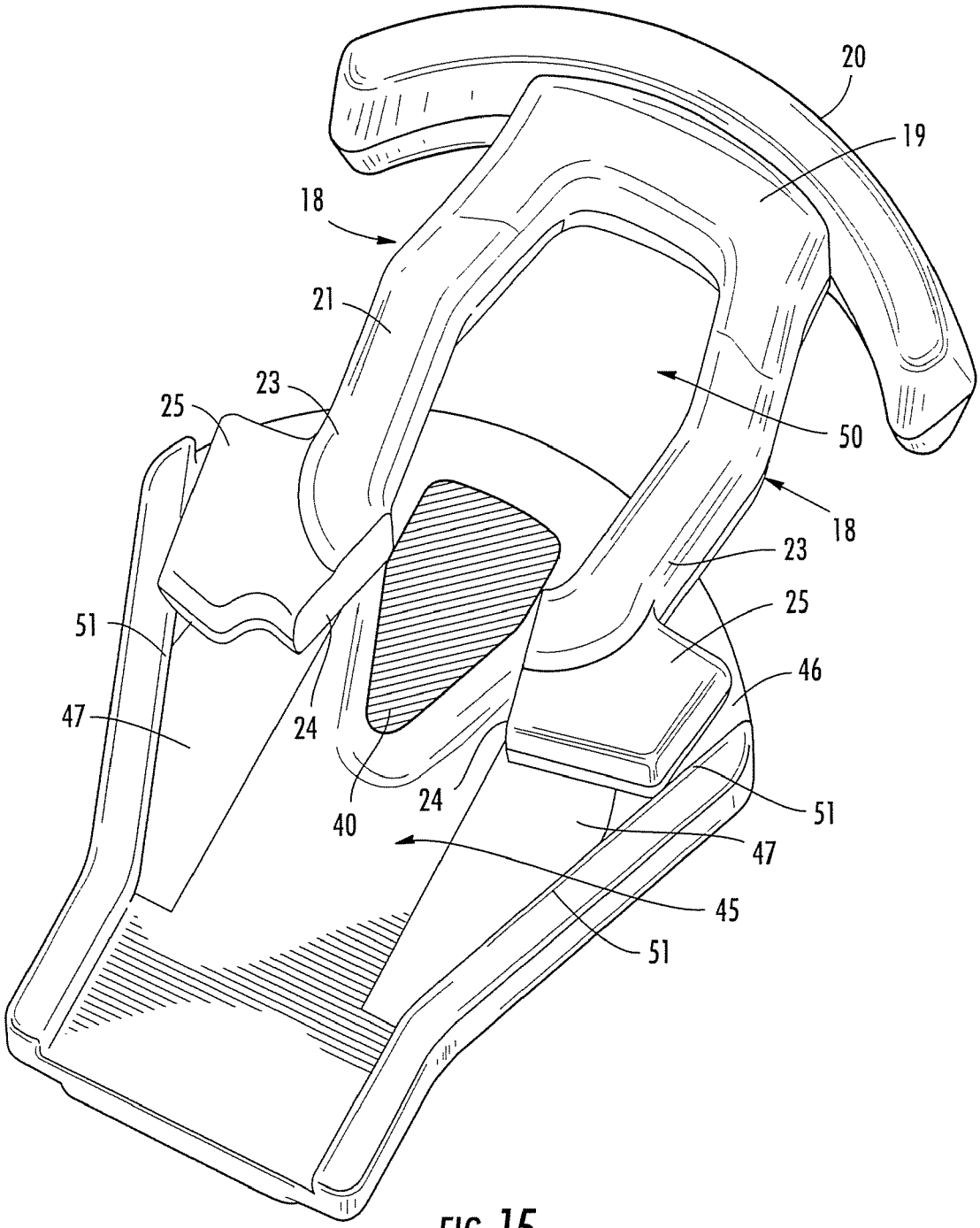
FIGS. 15-21 each represent a perspective of a detail of the slide fastener of FIG. 1 showing the upper stop and a lower element of the corresponding slider according to the present invention in a respective step of reciprocal coupling.
Figure 16:
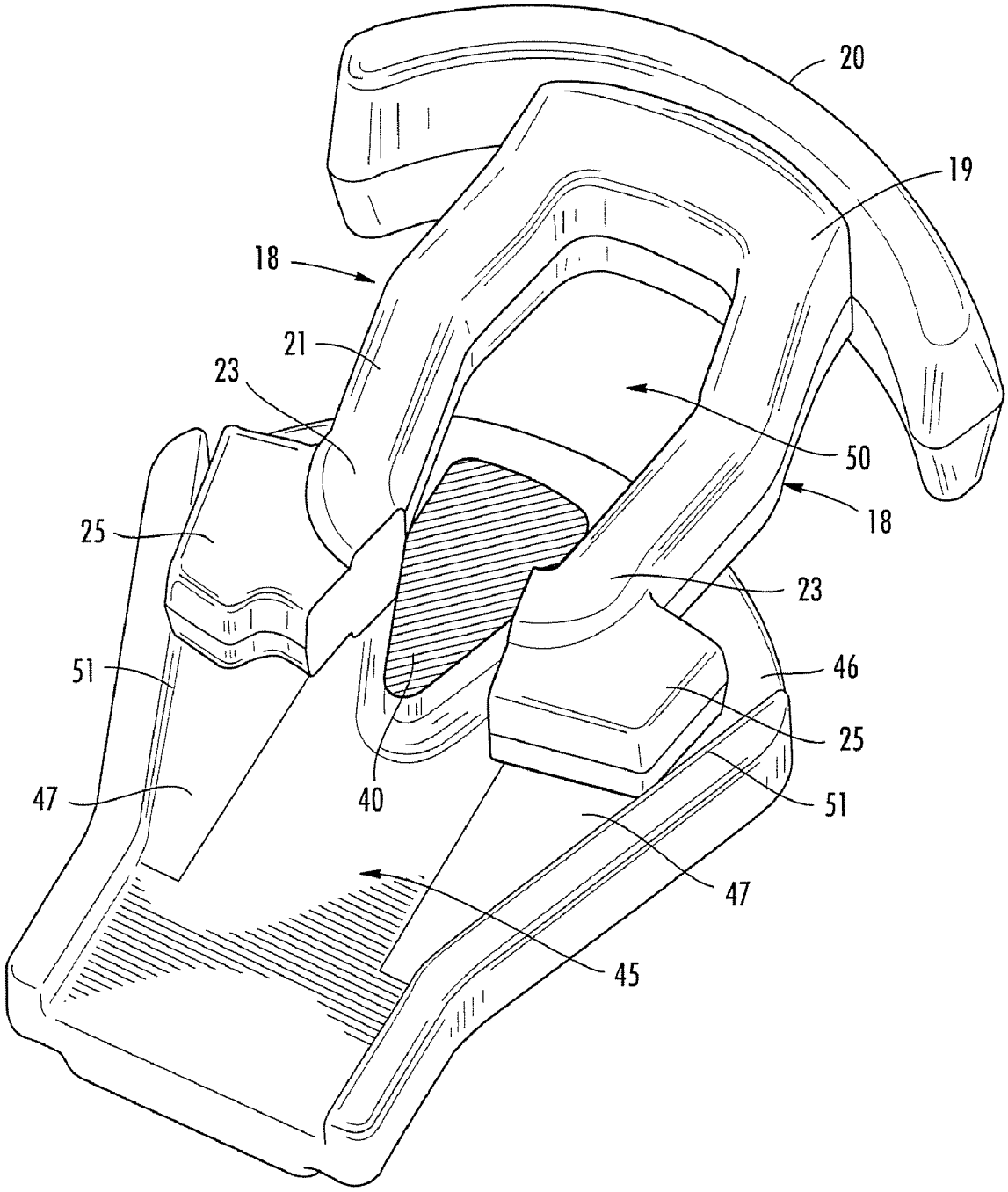
Figure 17:
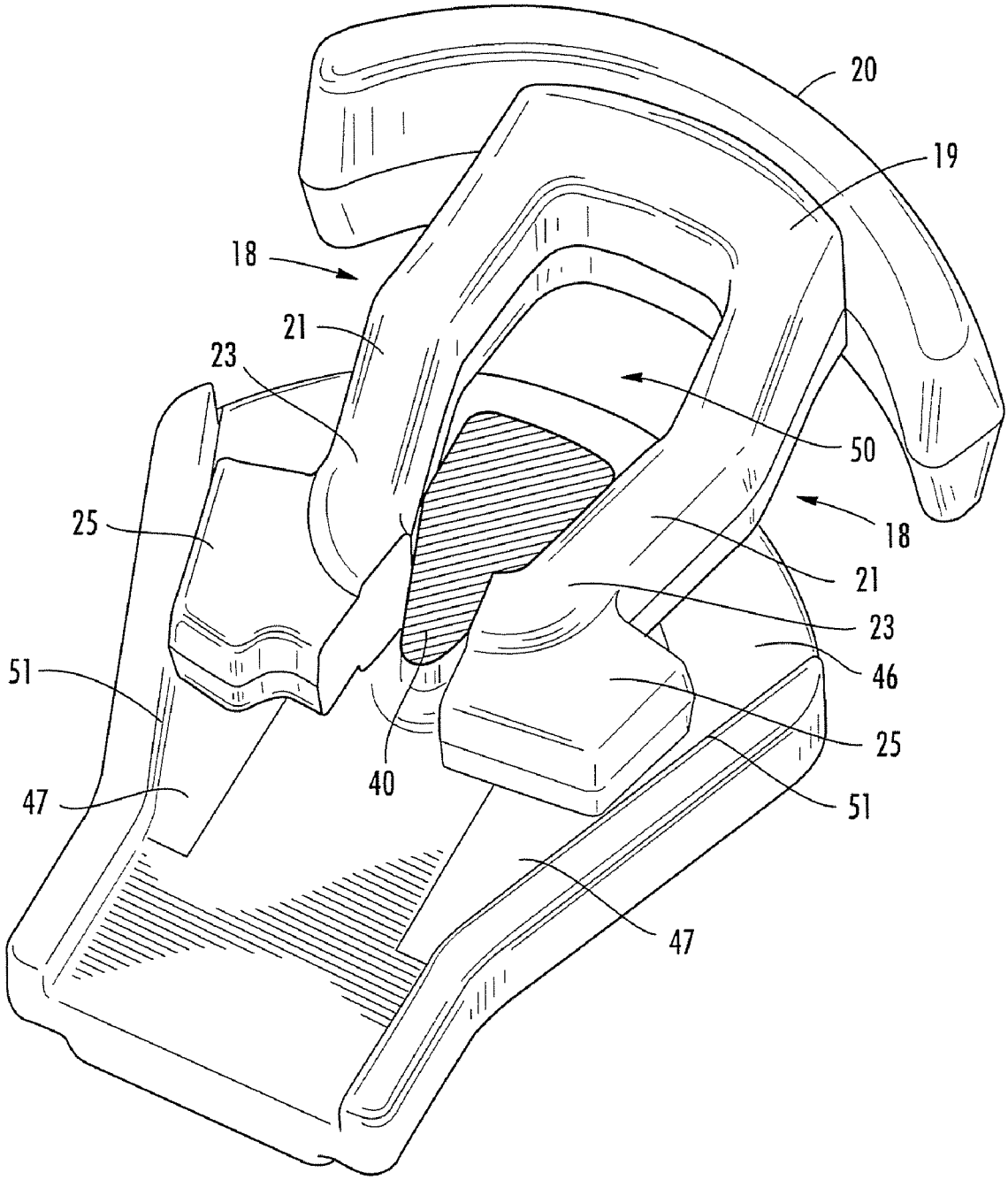
Figure 18:
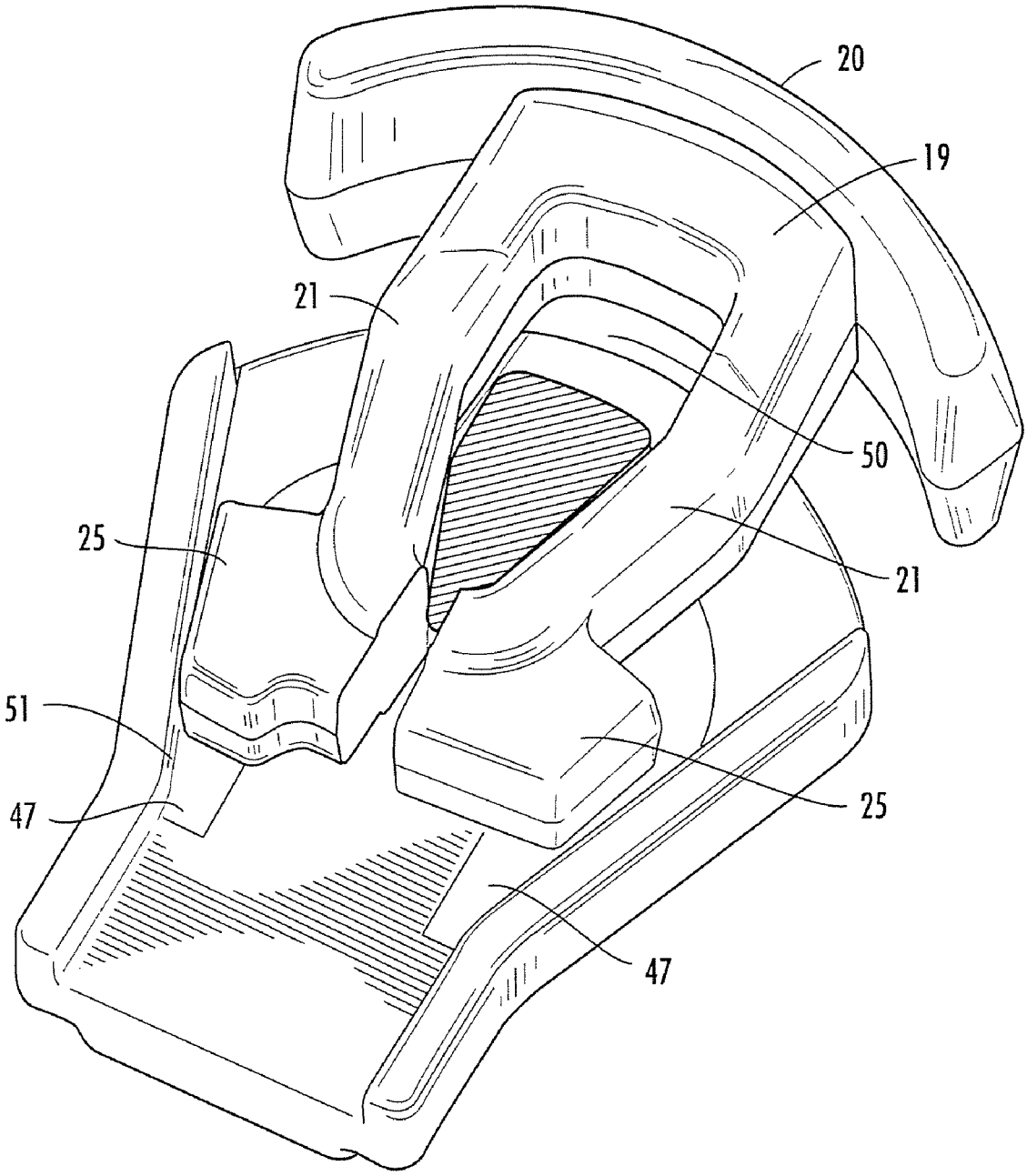
Figure 19:
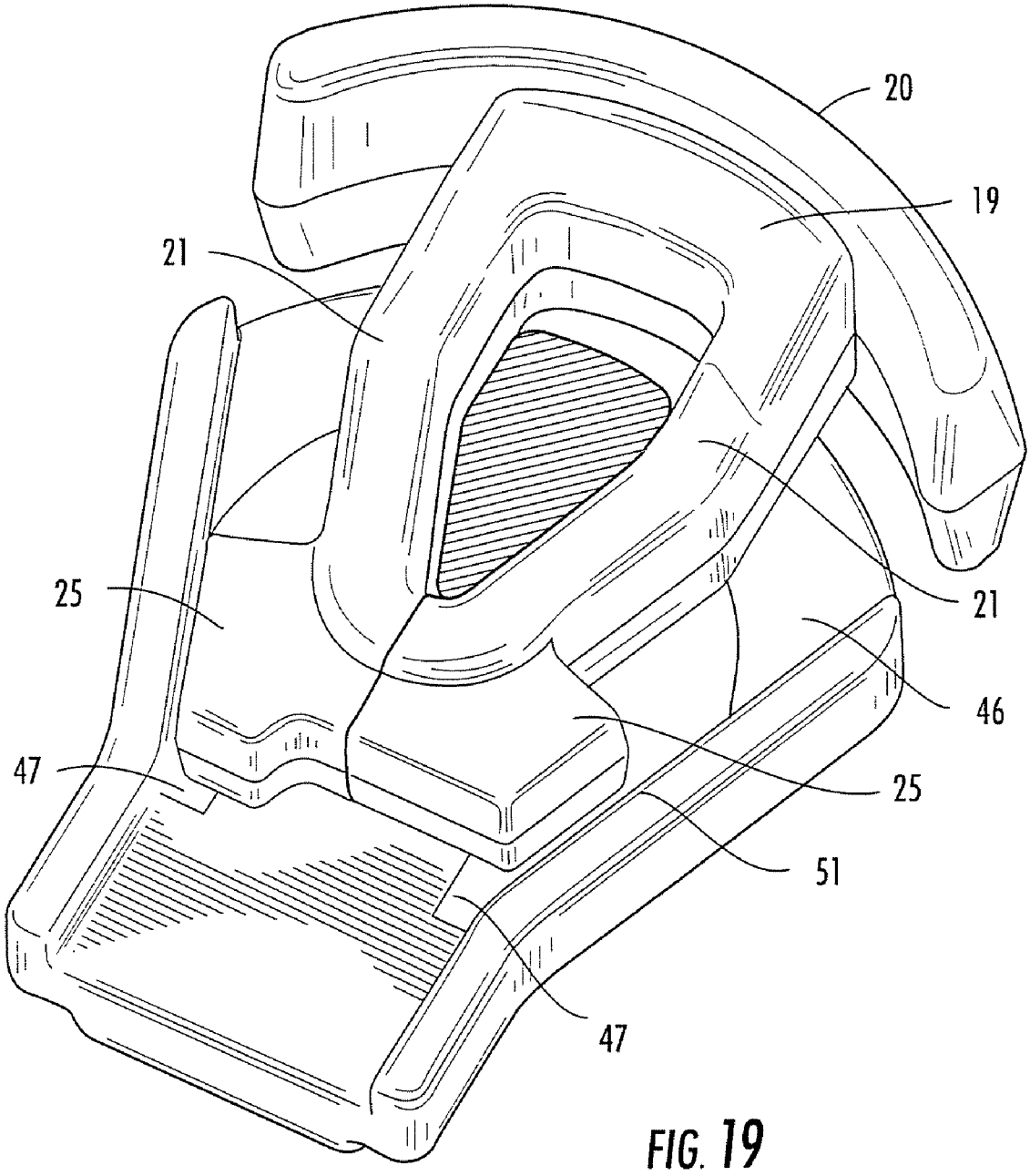
Figure 20:
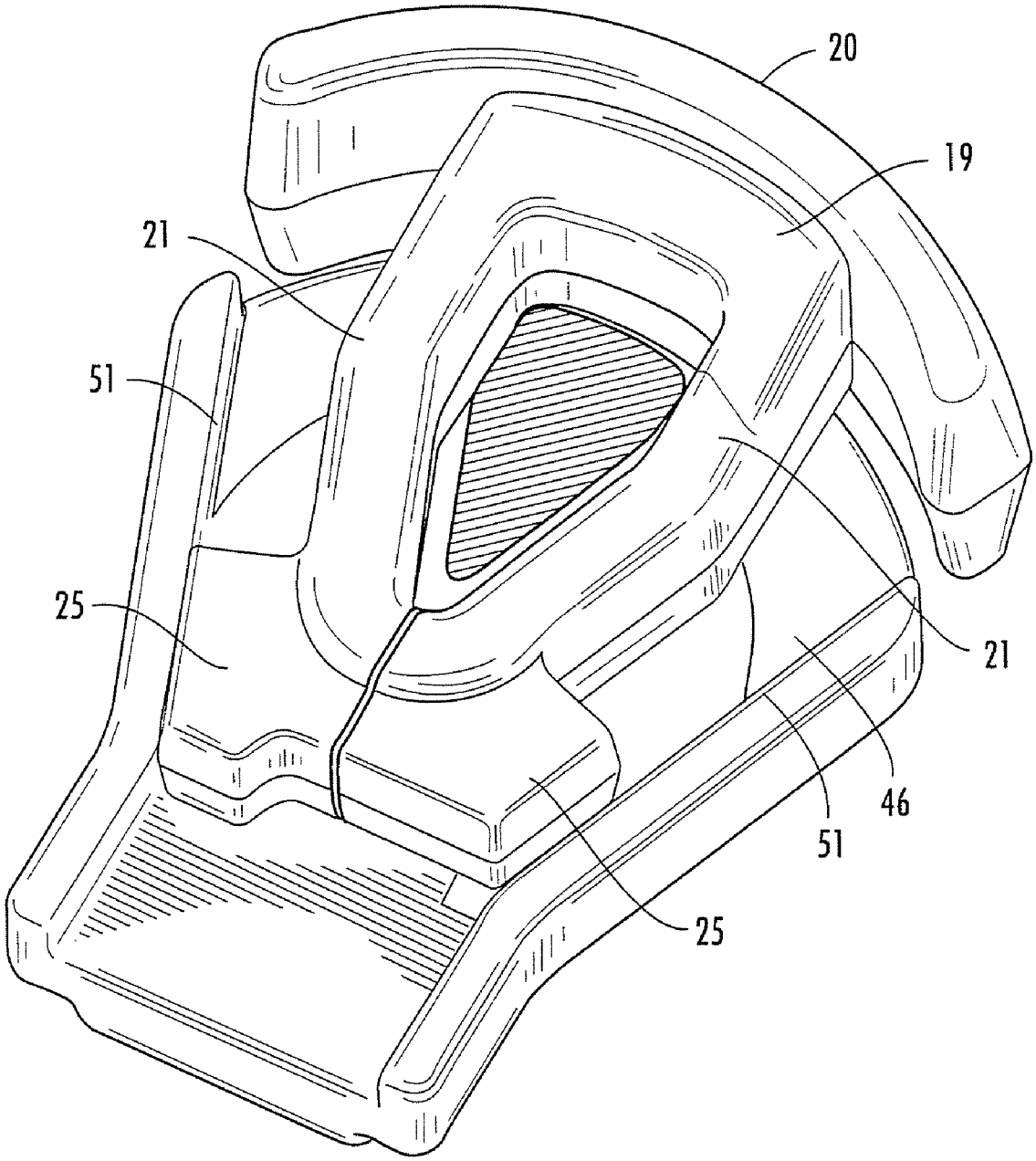
Figure 21:
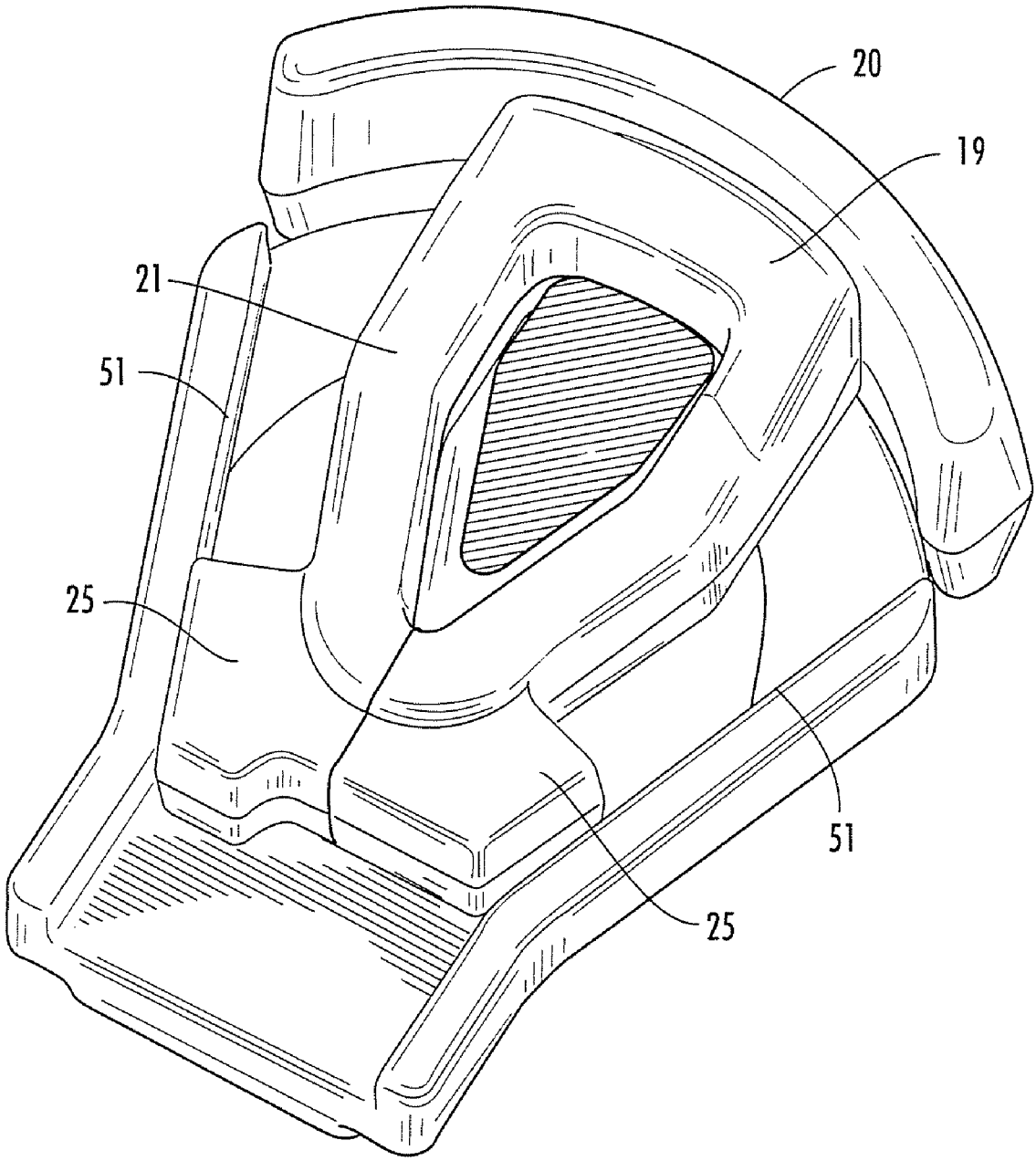

More in particular, in the block of plastic material composing the upper stop 16, two portions are distinguishable, specifically an upper 16*a* and a lower 16*b* portion, which are substantially symmetric with respect to a horizontal plane passing through a centre line of the upper stop. In correspondence with said centre line zone, the upper zone 16 is sealed on its external perimeter to the strips 12 by means of conventional techniques such as injection moulding. For example, the material composing the upper stop 16 can be injected in a suitable mould containing the coupling portions of the strips 12, so to form a seal covering thereon composed of said material, as is visible in FIG. 4D. In such a manner, in the use of the slide fastener 10 according to the invention, one of the upper stop portions 16, for example the upper portion 16*a*, will be turned towards the outside of the fabric to which said slide fastener 10 is attached, while the other of said portions, for example the lower portion 16*b*, will be turned towards the interior of the fabric.

In accordance with one aspect of the present invention, the opposing surfaces of the head portion 19 are tilted, thus to form a kind of ramp terminating at the front end 22 turned towards the shoulder 20 (or the free end 22 if the shoulder 20 is absent) while each of the arms 18 has two opposing sections 21 with tilted surface connected to the head portion 19 and forming a sort of ramp extending from the inside towards the outside of the respective arm 18.

The tilted surface sections 21 of the respective arms 18 are in turn followed by respective sections 23 with substantially planar and converging surfaces, so to close the seat 50 housing the diamond form 40 upon upper stop 16—slider 15 coupling, as will be explained in the following description.

Preferably, the head portion 19 has a greater slope than that of the sections 21 of the respective arms 18, in each of the blocks 16*a* and 16*b* of the upper stop 16.

In particular, according to a preferred embodiment of the invention, said head portion 19 has a slope with angle in the range of 5°-25°, while each section 21 of an arm 18 has a slope with angle not greater than 8°, with reference to a horizontal symmetry plane.

Preferably, the slope of each section 21 of an arm 18 can vary with angle which increases towards the front end 22 of the upper stop 16.

According to a particularly preferred embodiment of the invention, said head portion 19 has a slope with angle in the range of 10°-15°, while each section 21 of an arm 18 has a tilt with angle in the range of 2° and 6°, with reference to a horizontal symmetry plane.

In the upper stop 16, the arms 18 moreover comprise respective opposite appendages 25, each formed at an end portion of a respective arm 18, said appendages 25 being extended outward and downward from the respective arms 18 as extensions thereof.

Advantageously, one of the opposing appendages 25 has a recess 26 turned towards the tooth 14*a* closest to the upper stop 16, said recess having shape matching a head portion 14*b* of said tooth 14 which, upon completed closure of the strips 12, is not coupled with a corresponding opposite tooth 14.

In accordance with another aspect of the present invention (FIGS. 6-10), the slider 15 comprises an upper element 42 and a lower element or bottom 43 reciprocally coupled in a spaced relationship with each other through an intermediate diamond form 40. On the upper element 42, a slot portion 44 is formed for the engagement of a puller, not shown in the slider 15.

Internally, the upper and lower elements 42 and 43 define, together with the diamond form 40, a seat 45 having a substantially Y-shaped section for the passage of the teeth 14 during the sliding of the slider 15 so to determine the engagement or disengagement of the teeth 14 by means of the interaction, in a conventional manner, with a wedge portion 40*a* of the diamond form 40, and for the coupling with an upper stop 16 upon attainment of the end position.

In accordance with the present invention, the upper and lower elements 42 and 43 each have, internally, a first section 46 with sloped surface starting from the front end 15*a* of the slider 15, followed by second opposite; sections 47 with tilted surfaces connected to said first section 46.

Moreover, the diamond form 40 is preferable in rear position with respect to the front end 15*a* of the slider 15, so to facilitate the stop/slider taper fit and increase the related seal in the front part of the slider 15. In addition, such rear arrangement permits advantageously obtaining a greater opening for the entrance of the teeth, facilitating their entrance inside the slider 15 and consequently improving the closure slidability of the slide fastener 10.

Preferably, for each of the elements 42 and 43, said first section 46 has a greater slope than that of the second opposite sections 47.

More in particular, in accordance with the present invention (FIGS. 11-14), each first section 46 of a respectively upper and lower element 42 or 43 is mated with one of the opposite tilted surfaces of the head portion 19 of the upper stop 16 while each second tilted section 47 of a respectively upper and lower element 42 or 43 is mated with a respective tilted section 21 of one of the arms 18 of the upper stop 16.

In such a manner, upon completed coupling between the slider 15 and the upper stop 16, a clearance recovery taper fit is made, so-called clearance recovery wedge, which permits maintaining an effective and durable fluid seal between the slider 15 and the upper stop 16.

It should also be noted that the presence of sections with different slope in the seat 45 for the upper stop 16 permits making the slider 15 in a single piece by means of injection moulding, advantageously avoiding the risk of fluid seal problems deriving from the association of separate pieces.

Regarding the functioning of the slide fastener 10 (FIGS. 15-21) starting from a position of partial or total disengagement of the teeth 14, the slider 15 is made to slide along the rows 13 of teeth 14, with the aid of the relative puller, so to carry out the engagement between the opposite teeth 14 of respective rows 13.

This occurs in conventional manner by means of interaction of the opposite teeth 14 with the wedge portion 40*a* of the diamond form 40 in the suitable seat 45 of the slider 15.

Once the teeth are engaged 14, the further advancement of the slider 15 towards the upper stop 16 causes the opening of the arms 18 by the diamond form 40 (FIG. 15), at the planar surface portion 23 while at the same time the aforesaid arms 18 start to insert themselves in the seat 45 of the slider 15.

The insertion of the arms 18 in the seat 45 of the slider 15 then advantageously continues guided by the lateral walls 51 of the seat 45 (or the internal lateral walls 51 of the upper and lower elements 42 and 43 of the slider 15) which interact with the appendages 25 of the arms 18, while at the same time the diamond form 40 inserts itself in the respective seat 50 of the upper stop 16 (FIGS. 16-20).

Due to the narrowing of the seat 45 section of the slider 15 from the front end 15*a* towards the interior, the appendages 25 of the arms 18 are advantageously thrust continually towards the interior during the insertion of the upper stop 16 in the slider 15, until they are substantially in abutment against each other, determining the abutment of the arms 18 against each other at the respective ends 24, upon completed insertion.

Moreover, upon completed insertion (FIG. 21), the head portion 19 of the upper stop 16, through the respective opposite tilted surfaces, is coupled to respective first tilted mated sections 46 of the upper and lower 42 and 43 elements of the slider 15, while the arms 18 of the upper stop 16 are coupled, at respective tilted sections 21, to second mated tilted sections 47 of the upper and lower elements 42 and 43 of the slider 15. Such coupling between mated portions of the upper stop 16 and slider 15 makes a taper fit with clearance recovery, so-called clearance recovery wedge, which advantageously permits maintaining the fluid seal in an effective and enduring manner.

In accordance with another aspect of the present invention, the upper stop 16 is made of a sufficiently flexible and soft thermoplastic material, also compatible with the waterproof covering material of the strips 12, so to easily permit the opening of the arms 18 during the insertion of the diamond form 40 in the seat 50 but also a slight flattening of the arms 18, at the respective free ends 24, at the time of abutment of the same against each other, caused by the thrust of the lateral walls 51 of the slider 15.

Preferably, the aforesaid thermoplastic material is composed of soft polyurethane.

Moreover, the slide fastener 10 can be provided with means for ensuring the locking of the slider 15 in the stop position on the upper stop 16 in order to avoid that it even slightly pulls back due to external forces which are different from those desired for opening the slide fastener 10. Such means can be composed of appropriate anchoring systems which are per se conventional and hence are not represented here.

Figure 22A:
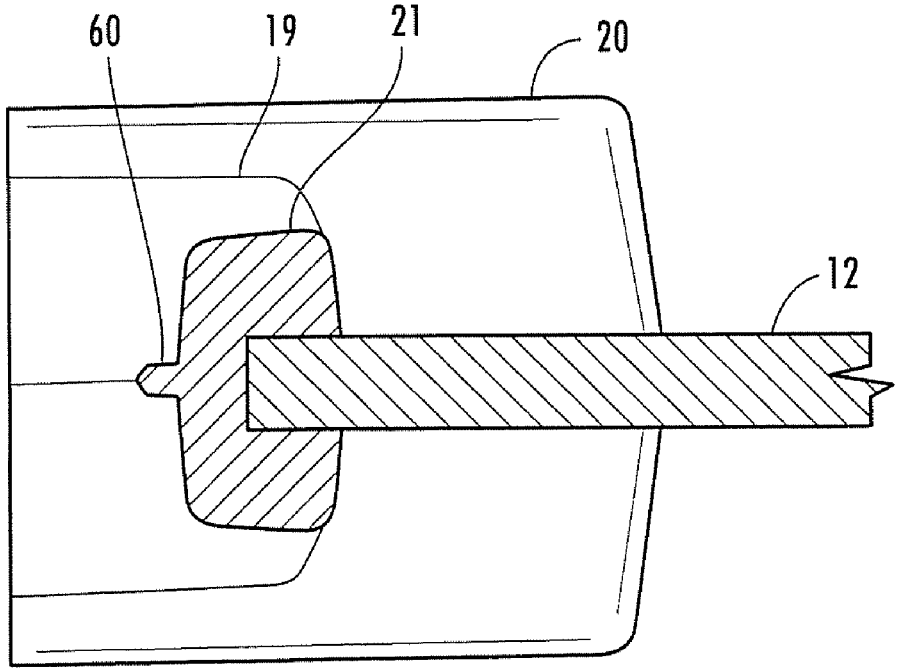
FIGS. 22A and 22B each show a section view of a detail of a slide fastener according to further embodiments of the invention.
Figure 22B:
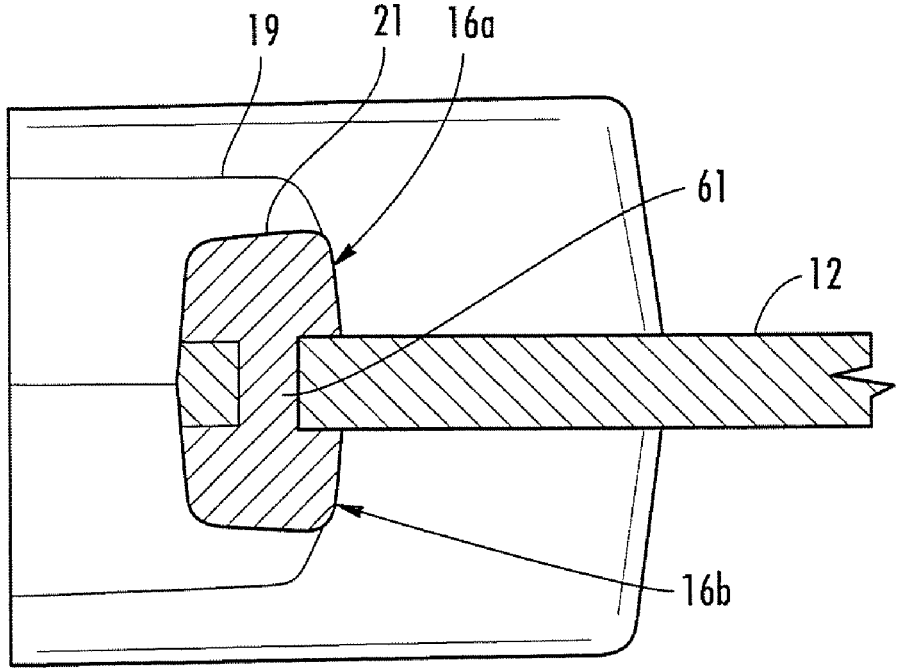

FIGS. 22A and 22B each show a detail of a slide fastener according to a further embodiment of the invention. More in detail, with reference to FIG. 22A, the upper stop 16 has a gasket (or diaphragm) 60 extended along an internal perimeter section turned towards the seat 50 of the diamond form 40. Upon reaching the upper end, such gasket 60 interacts with the seat 45 of the slider 15, permitting the further improvement of the fluid seal between the slider 15 and the upper stop 16.

Instead, in FIG. 22B, another system for sealing the upper stop 16 to the strips 12 is shown in which the upper position 16*a* and the lower position 16*b* of said upper stop 16 are sealed on the opposite surfaces of the coupling portions of the strips 12, and are joined together by sections 61 passing through said coupling portions of the strips 12. This can be achieved by making through holes in said coupling portions of the strips and then injecting the material constituting the upper stop 16 in a suitable mould containing the holed coupling portions of the strip 12, thus to form a sealed covering thereon.

In addition to the abovementioned advantages, it should be noted that the slide fastener according to the invention is simple and economic to make and is adapted for mass production.

Of course, a man skilled in the art, in order to satisfy specific and contingent needs, can make numerous modifications and variants to the above-described slide fastener, all moreover contained in the protective scope of the present invention as defined by the following claims. For example, the arms of the upper stop can lack flat surface sections and have one or more tilted surfaces for the taper fit with corresponding mated tilted surfaces of the slider. Moreover, the upper stop 16 can be provided with surface ribbing, preferably in the flat portion, to further increase the seal between the upper stop 16 and the slider 15 in the end position of the latter.

The invention claimed is:

1. A fluid tight slide fastener comprising:

two flanking strips, each of said flanking strips having a row of closure elements;

a slider slidably associated with opposite edges of said two flanking strips to provide for their closure; and an upper end stop with which said slider is removably engaged upon closure, wherein said upper end stop has at least one section with a first tilted surface having a slope with reference to a horizontal symmetry plane with respect to the upper end stop;

wherein said slider has at least one section with a second tilted surface having a slope with reference to said horizontal symmetry plane; and wherein said first tilted surface of the upper end stop matches said second tilted surface of the slider, such that said first and second tilted surfaces are complementary to each other, providing a clearance-recovery wedge coupling between the slider and the upper end stop upon closure of the slide fastener and engagement of said slider with said upper end stop.

2. The slide fastener according to claim 1, wherein said tilted surfaces are formed integrally in said upper end stop and in said slider, respectively.

3. The slide fastener according to claim 1, wherein said upper end stop is composed of a block of plastic material sealed on the outer perimeter to said strips, said block comprising a head portion connected to a pair of opposite left and right arms, said arms and said head portion forming a seat for a diamond of said slider.

4. The slide fastener according to claim 3, wherein said head portion of the upper end stop has said tilted surfaces on opposite top and bottom sides, and each of said left and right arms of the upper end stop has tilted surface sections on opposite top and bottom sides.

5. The slide fastener according to claim 4, wherein the slope of the tilted surfaces of the head portion of the upper end stop is greater than a slope of the tilted surfaces of the arms of the upper end stop.

6. The slide fastener according to claim 5, wherein the slope of the tilted surfaces of the head portion is in the range of 5°-25°, while the slope of the tilted surfaces of the arms is not greater than 8° with reference to said horizontal plane of symmetry.

7. The slide fastener according to claim 5, wherein each tilted surface of said arms has a variable slope.

8. The slide fastener according to claim 7, wherein said slider comprises an upper element and a lower element connected by a middle diamond core and internally forming a seat for said upper end stop.

9. The slide fastener according to claim 8, wherein said slider comprises a front tilted surface followed by a left tilted surface and a right tilted surface, the left and right tilted surfaces being formed in each of said upper and lower elements.

10. The slide fastener according to claim 9, wherein for each of the upper and lower elements, the slope of said front tilted surface is greater than the slope of said left and right tilted surfaces.

11. The slide fastener according to claim 9, wherein each front tilted surface of an upper or lower element of the slider is mated with one of the opposite tilted surfaces of the head portion of the upper end stop while the left and right tilted surfaces of an upper or lower element is mated to a respective tilted section of one of the arms of the upper end stop.

12. The slide fastener according to claim 9, wherein said diamond is in a rear position with respect to the front end of said slider.

13. The slide fastener according to claim 9, wherein the arms of the upper end stop have respective appendages towards the exterior, said appendages being guided by lateral walls of said seat of the slider during the engagement of the upper end stop with the slider, and substantially come into abutment against each other upon completed engagement.

14. The slide fastener according to claim 6, wherein the slope of the titled surfaces of the head portion is in the range of 10°-15°, while the slope of the tilted surfaces of the arms is between 2°-6° with reference to said horizontal plane of symmetry.

15. The slide fastener according to claim 7, wherein each tilted surface of said arms has a variable slope with the angle increasing towards the front end of the upper end stop.

* * * * *